US009664157B2

(12) United States Patent
Hu et al.

(10) Patent No.: US 9,664,157 B2
(45) Date of Patent: May 30, 2017

(54) DEVICE AND METHOD FOR CONTROLLING HIGH-PRESSURE COMMON-RAIL SYSTEM OF DIESEL ENGINE

(75) Inventors: Guangdi Hu, Shandong (CN); Shaojun Sun, Shandong (CN); Dehui Tong, Shandong (CN)

(73) Assignee: Weichai Power Co., Ltd., Weifang (CN)

( * ) Notice: Subject to any disclaimer, the term of this patent is extended or adjusted under 35 U.S.C. 154(b) by 666 days.

(21) Appl. No.: 14/112,919

(22) PCT Filed: Apr. 19, 2011

(86) PCT No.: PCT/CN2011/073003

§ 371 (c)(1),
(2), (4) Date: Oct. 18, 2013

(87) PCT Pub. No.: WO2012/142744

PCT Pub. Date: Oct. 26, 2012

(65) Prior Publication Data

US 2014/0041634 A1 Feb. 13, 2014

(51) Int. Cl.

| | |
|---|---|
| ***F02M 41/00*** | (2006.01) |
| ***F02D 41/14*** | (2006.01) |
| ***F02D 41/38*** | (2006.01) |

(52) U.S. Cl.

CPC ..... *F02M 41/00* (2013.01); *F02D 41/1401* (2013.01); *F02D 41/3845* (2013.01);
(Continued)

(58) Field of Classification Search

CPC ..... F02M 41/00; F02D 41/14; F02D 41/1401; F02D 41/3845; F02D 2041/1409;
(Continued)

(56) References Cited

U.S. PATENT DOCUMENTS 4,884,545 A * 12/1989 Mathis ..... F02D 41/3845 123/446
5,094,216 A * 3/1992 Miyaki ..... F02D 41/3827 123/456

(Continued)

*Primary Examiner* — Hung Q Nguyen
*Assistant Examiner* — John Bailey
(74) *Attorney, Agent, or Firm* — Fenwick & West LLP

(57) ABSTRACT

An apparatus for controlling a high pressure common rail system of a diesel engine includes an operation condition parameter acquiring module configured to acquire operation condition parameters associated with the high pressure common rail system; a control quantity determining module coupled with the operation condition parameter acquiring module and configured to determine a control quantity for controlling the high-pressure common rail system based on the operation condition parameters, a target value of the fuel pressure within a high pressure common rail tube cavity and a control model designed based on a system physical model, wherein the control quantity is an equivalent cross-section area of the electromagnetic valve of a flow metering unit; and a drive signal determining module coupled to the control quantity determining module and configured to determine a drive signal for driving the flow metering unit based on the determined control quantity.

14 Claims, 4 Drawing Sheets

(52) U.S. Cl.
CPC .. *F02D 2041/141* (2013.01); *F02D 2041/143* (2013.01); *F02D 2041/1409* (2013.01); *F02D 2200/0602* (2013.01); *F02D 2250/31* (2013.01)

(58) Field of Classification Search
CPC ..... F02D 2041/143; F02D 2200/0602; F02D 2250/31; F02D 2041/141
USPC ..... 123/452, 456, 457, 445, 446, 447, 448, 123/458, 462, 495, 497, 510, 511, 512, 123/513, 514, 339.1, 339.14, 339.29, 344, 123/364, 365, 375, 376, 378, 379, 387, 123/390, 402, 403; 417/279
See application file for complete search history.

(56) References Cited

U.S. PATENT DOCUMENTS 5,133,645 A * 7/1992 Crowley ..... F02M 47/027 123/447
5,404,855 A * 4/1995 Yen ..... F02M 45/04 123/446
5,486,097 A * 1/1996 Schaffner ..... F04B 49/002 417/218
5,678,521 A * 10/1997 Thompson ..... F02M 63/00 123/446
5,983,863 A * 11/1999 Cavanagh ..... F02D 41/20 123/447
6,053,147 A * 4/2000 Hemmerlein ..... F02D 41/222 123/198 D
6,085,727 A * 7/2000 Nakano ..... F02D 41/1401 123/447
6,293,251 B1 * 9/2001 Hemmerlein ..... F02D 41/222 123/357
6,349,702 B1 * 2/2002 Nishiyama ..... F02D 41/3836 123/447
6,484,696 B2 * 11/2002 Barnes ..... F02D 41/1401 123/446
6,701,898 B2 * 3/2004 Tokuo ..... F02D 41/38 123/456
7,073,486 B2 * 7/2006 Nomura ..... F02D 41/38 123/446
7,293,548 B2 * 11/2007 Oono ..... F02D 41/3845 123/446
7,690,361 B2 * 4/2010 Vogt ..... F02M 59/20 123/506
7,706,957 B2 * 4/2010 Yamada ..... F02D 41/2438 123/305
7,757,669 B2 * 7/2010 Okamoto ..... F02D 41/3845 123/508
7,779,816 B2 * 8/2010 Dolker ..... F02D 41/3845 123/456
7,848,868 B2 * 12/2010 Nakagawa ..... F02D 41/3863 123/357
2002/0139350 A1 * 10/2002 Barnes ..... F02D 41/1401 123/456
2004/0055576 A1 * 3/2004 McCarthy, Jr. ..... F02D 41/0087 123/458
2004/0194762 A1 * 10/2004 Okamoto ..... F02D 41/3872 123/458
2004/0267433 A1 * 12/2004 Asano ..... F02D 41/123 701/104
2005/0098158 A1 * 5/2005 Asano ..... F02D 41/2438 123/436
2008/0216797 A1 * 9/2008 Oono ..... F02D 41/062 123/447
2009/0093942 A1 * 4/2009 Okamoto ..... F02D 41/3845 701/103
2009/0308351 A1 * 12/2009 Okamoto ..... F02D 41/3845 123/456
2010/0269790 A1 * 10/2010 Ohta ..... F02D 41/3845 123/447
2011/0253103 A1 * 10/2011 Talwar ..... F02D 41/401 123/445
2013/0060448 A1 * 3/2013 Nakada ..... F02D 41/0007 701/102
2014/0034022 A1 * 2/2014 Hu ..... F02D 41/3845 123/456

* cited by examiner

DEVICE AND METHOD FOR CONTROLLING HIGH-PRESSURE COMMON-RAIL SYSTEM OF DIESEL ENGINE

FIELD OF THE INVENTION

The present disclosure generally relates to the technical field of diesel engine, and more specifically, relates to an apparatus and method for controlling a high pressure common rail system of the diesel engine.

BACKGROUND OF THE INVENTION

With the increasing aggravation of energy crisis, various energy consumption technologies have become focus issues in the combustion engine industry all over the world. Just due to this reason, diesel engines have attracted more and more attention. Compared with gasoline engines, diesel engines have many advantages: reduced exhaust gas emission, better acceleration performance at a lower vehicle speed, lower average fuel consumption, and more driving fun. However, as compared with gasoline engines, emission control is a challenge for diesel engines. In order to meet emission standards, a high pressure common rail technology has become a hot topic in the industry.

In a high pressure common rail fuel injection system (hereinafter referred to a high pressure common rail system) of an existing diesel engine, a PID type control policy is employed for controlling fuel pressure within a common rail tube chamber (i.e., rail pressure), which requires massive calibration work. Besides, based on the existing PID control policy, in some operation conditions of an engine, there would be a large gap between the actual value and the target value of the rail pressure, which causes a relatively large error between the actual fuel injection amount and the target fuel injection amount in a fuel injection system, which therefore directly affects the consistency between the power of the engine and fuel injection within each cylinder. Therefore, it is crucial for improving engine performance and reducing the calibration work to develop an advanced fuel pressure control policy for the high-pressure common rail system. To this end, there is a need in the art for improving the control technology for the high pressure common rail system.

SUMMARY OF THE INVENTION

In view of the above, the present invention discloses an apparatus and method for controlling a high pressure common rail system of a diesel engine so as to overcome or at least partially eliminate at least some of the drawbacks in the prior art.

According to one aspect of the present invention, there is provided an apparatus for controlling a high pressure common rail system of a diesel engine. The apparatus may comprise an operation condition parameter acquiring module configured to acquire operation condition parameters associated with the high pressure common rail system; a control quantity determining module coupled to the operation condition parameter acquiring module and configured to determine a control quantity for controlling the high-pressure common rail system based on the operation condition parameters, a target value of the fuel pressure within a high pressure common rail tube chamber and a control model designed based on a physical model characterizing the high pressure common rail system, wherein the control quantity is an equivalent cross-section area of electromagnetic value of a flow metering unit; and a drive signal determining module coupled to the control quantity determining module and configured to determine a drive signal for driving the flow metering unit based on the determined control quantity.

In a preferred embodiment according to the present invention, the apparatus may further comprise: an observation value determining module coupled to the operation condition parameter acquiring module and the control quantity determining module and configured to determine, based on the operation condition parameters and an observer model designed based on the physical model, an observation value of fuel pressure within a high pressure fuel pump plunger chamber, for using by the control quantity determining module in determining the control quantity.

According to a yet another preferred embodiment of the present invention, the observer model may be designed by adding an adjustment term to an equation for the fuel pressure within the plunger pump chamber and to an equation for the fuel pressure within the high pressure common rail tube chamber in the physical model, respectively, and by selecting an adjustment factor to make both adjusted equations stable and converged.

In a further preferred embodiment according to the present invention, the observation value determining module may be further configured to determine an observation value of fuel pressure within the high pressure common rail tube chamber based on the operation condition parameters and the observer model, for using by the control quantity determining module in determining the control quantity.

In yet another preferred embodiment according to the present invention, the operation condition parameters may include: high pressure fuel pump plunger stroke, high pressure fuel pump plunger movement line speed, fuel pressure within the plunger pump chamber, and fuel pressure within the high pressure common rail tube chamber.

In yet another preferred embodiment of the present invention, the physical model can be characterized by: an equation for fuel outflow of the flow metering unit; an equation for fuel pressure within the plunger pump chamber; an equation for fuel outflow of the plunger pump chamber; an equation for fuel pressure within the high pressure common rail tube chamber; and an equation for fuel injection flow of a fuel injector.

In a further preferred embodiment according to the present invention, the control model may comprise a feedforward controller, and said control quantity may include a feedforward control component.

In another preferred embodiment according to the present invention, the feedforward control component $u_{FF}$ can be expressed as $$u_{FF} = -\frac{1}{b_3}(b_1 + b_2\theta),$$

wherein $b_1$, $b_2$ and $b_3$ are control coefficients which are determined based on the acquired operation condition parameters and constant parameters associated with the physical model; and $\theta$ denotes high pressure fuel pump plunger movement line speed.

In yet another preferred embodiment of the present invention, the control model may comprise a feedback controller, and said control quantity may include a feedback control component.

In a further preferred embodiment of the present invention, the feedback control component $U_{FB}$ can be expressed as $$u_{FB} = -\frac{1}{b_3}\left(k_p e + k_1 \int e + k_d \dot{e}\right),$$

wherein e denotes an error between the fuel pressure within the high pressure common rail tube chamber and its target value; $b_3$ is a control coefficient determined based on the acquired operation condition parameters and constant parameters associated with the physical model; and $k_P$, $k_i$ and $k_d$ are control coefficients respectively for proportional control, integral control and differential control and $k_P$, $k_i$ and $k_d$ are selected to stabilize the high pressure common rail system.

According to another aspect of the present invention, there is provided a method for controlling a high pressure common rail system of a diesel engine. The method may comprise: acquiring operation condition parameters associated with the high pressure common rail system; determining a control quantity for controlling the high-pressure common rail system based on the operation condition parameters, a target value of fuel pressure within a high pressure common rail tube chamber and a control model designed based on a physical model characterizing the high pressure common rail system, wherein the control quantity is an equivalent cross-section area of electromagnetic value of a flow metering unit; and determining a drive signal for driving the flow metering unit based on the determined control quantity.

According to embodiments of the present invention and particularly various preferred embodiments, the high pressure common rail system is controlled based on the physical model charactering the high pressure common rail system of a diesel engine. Because the physical model of the high pressure common rail system of the diesel engine is suitable to a working process of the system in any operation condition, the physical model-based technical solution of the present invention may achieve a relatively accurate injection pressure and a fast system response, which in turn may reduce the deviation between the actual value of the rail pressure and its target value, and minimize it in preferred embodiments. In addition, a control model designed based on the physical model of the high-pressure common rail fuel system can be quantized, which thus greatly reduces the calibration workload for the control model, and improves the efficiency and functionality of the high pressure common rail fuel injection system of the engine.

BRIEF DESCRIPTION OF THE DRAWINGS

The above and other features of the present invention will become more apparent through detailed description of the embodiments as illustrated with reference to the accompanying drawings, in which like reference signs indicate like or similar components. In the accompanying drawings, FIG. 1 schematically illustrates a structural diagram of a high pressure common rail system of a diesel engine.

DETAILED DESCRIPTION OF EMBODIMENTS

Hereinafter, an apparatus and method for controlling a high pressure common rail system as provided by the present invention will be depicted in detail through embodiments with reference to the accompanying drawings. It should be understood that these embodiments are provided only to enable those skilled in the art to better understand and further implement the present invention, not intended for limiting the scope of the present invention in any manner.

Additionally, the term "operation condition parameter" used herein indicates any value that can indicate a physical quantity of the (target or actual) physical state or operation condition of the engine. Moreover, in the context of this specification, term "parameter(s)" may be used interchangeably with the physical quantity represented thereby. For example, "a parameter indicating a camshaft rotary speed" has an equivalent meaning herein with "camshaft rotary speed." Moreover, in the context of the present specification, P denotes a certain physical quantity, then $\dot{P}$ denotes a derivative of P with respect to time, i.e, P's change ratio with time; $\hat{P}$ denotes an observation value of the physical quantity P, i.e., filtered measured value (the measured value comprising noise); P=P(x) denotes that the parameter P is a polynomial of x, i.e., P is a function of x, and $P=P(x_1, x_2)$ denotes that the parameter P is the polynomial of $x_1$ and $x_2$.

Besides, the term "acquire" and its derivatives used herein include various means currently known or to be developed in future, for example, collecting, measuring, reading, estimating, predicting, observing, etc.; the term "measure" and its derivatives used here include various means currently known or to be developed in the future, such as means of directly measuring, reading, computing, estimating, etc.

Figure 1:
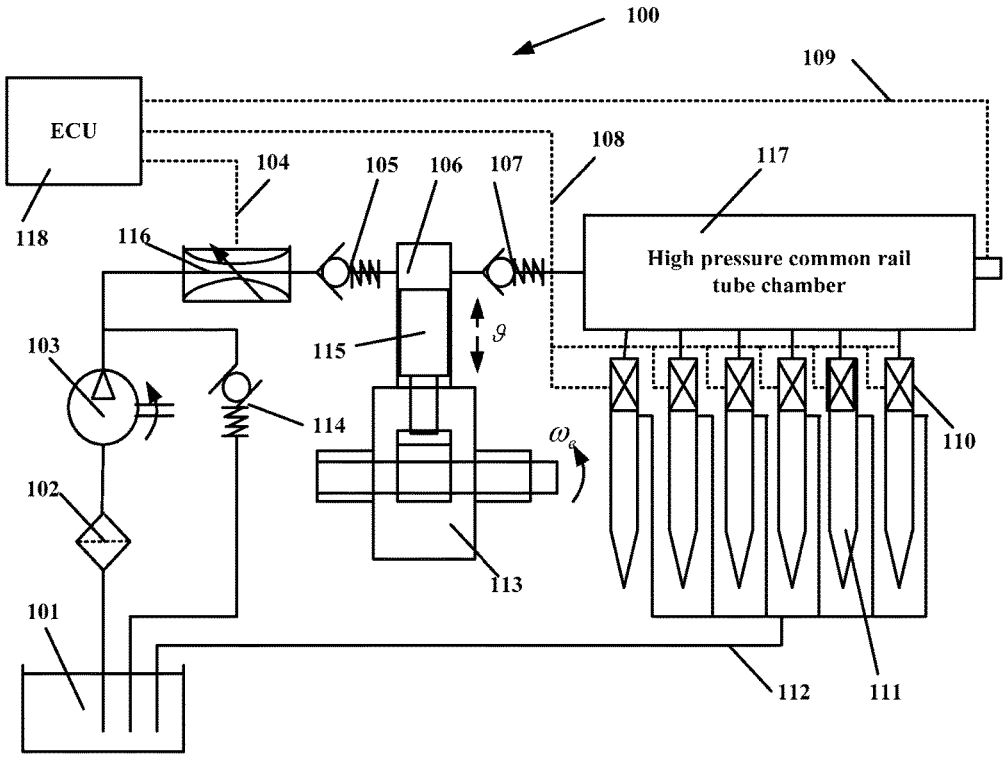

Next, the structural diagram of a high pressure common rail system of a diesel engine will be first depicted with reference to FIG. 1. It should be understood that FIG. 1 illustrates only those parts associated with the present invention in a high pressure common rail system of a diesel engine. Actually, the high pressure common rail system 100 may also include any number of other components.

As shown in FIG. 1, the high pressure common rail system 100 includes a fuel tank 101, a fuel filter 102, a low pressure pump 103, a one-way valve 114, a flow metering unit 116, a one-way valve 105, a high pressure pump 113, a one-way valve 107, a high pressure common rail tube chamber 117, a fuel injector drive electromagnetic valve 110, a fuel injector 111, and an electric control unit (ECU) 118. In the fuel tank 101 is contained liquid fuel that is to be provided to the fuel injector 111 through the high-pressure common rail system 100. The fuel is filtered via the fuel filter 102 to filter off the impurities therein. The filtered fuel is preliminarily pressurized via the low pressure pump 103 to pre-pressurize the fuel originally at atmosphere pressure to about 8-9 atm. The fuel flow metering unit 116, such as a flow metering valve, may take a form of an electromagnetic valve, which is configured to control, in response to a drive signal 104 from the ECU, fuel flow into the fuel injection pump chamber (also called plunger pump chamber) 106 of the high pressure pump 113 by changing the equivalent cross-section area of the electromagnetic valve. When the pressure of the fuel flowing out of the flow metering unit 116 is higher than the pressure within the plunger pump chamber 106, the fuel enable the one-way valve 105 to open against the pretightening force provided by a spring member of the one-way value 105 and, such that the fuel flows into the plunger pump chamber 106 of the high pressure pump 113, while when the pressure of the fuel flowing out of the flow metering unit 116 is lower than the pressure within the plunger pump chamber 106, the one-way valve 105 is closed to thereby block the fuel from flowing into the piston pump chamber 106. Therefore, the one-way valve 105 actually provides a one-way fuel path from the flow metering unit 116 and the plunger pump chamber 106.

As shown in FIG. 1, the high pressure pump 113 includes a high pressure pump plunger 115 and a plunger pump chamber 106. Driven by the camshaft of the injection pump, the high-pressure pump plunger 115 performs reciprocation movements in the plunger pump chamber 106. On the one hand, when the high pressure pump plunger 115 moves downward, the pressure within the piston pump chamber 106 will be gradually reduced and form a vacuum, such that the pressure of the fuel flowing out of the flow metering unit 116 is greater than the pressure within the plunger pump chamber 106, and therefore, the one-way valve 105 is opened and the fuel enters into the plunger pump chamber 106. On the other hand, when the high pressure pump plunger 115 moves upward, the fuel in the plunger pump chamber 106 is subjected to pressure to form high-pressure fuel; at this point, the one-way valve 105 is closed; besides, when the fuel pressure is higher than the fuel pressure within the high pressure common rail tube chamber 117, the one-way valve 107 is opened such that the fuel enters into the high pressure common rail tube chamber 117. Therefore, similar to the aforementioned one-way valve 105, the one-way valve 107 provides a one-way path for the high pressure fuel to enter into the high pressure common rain tube chamber 117 from the plunger pump chamber 106.

The high pressure common rail tube chamber 117 plays a role of an accumulator for reserving high-pressure fuel. In general, the pressure of the high pressure fuel may usually reach as high as 120 Mpa to 200 Mpa. However, it should be noted that, for different high pressure common rail systems, the pressures can be slightly different.

The fuel injector 111 is a key component in the high pressure common rail system, which plays a role of injecting the high pressure fuel in the high pressure common rail tube chamber 117 into each cylinder at the optimal fuel injection timing, with the optimal fuel injection volume, and at the optimal fuel injection flow through controlling the opening and closing of the fuel injector drive electromagnetic valve 110 in accordance with the drive signal 108 from the ECU.

In addition, a pressure sensor is usually mounted on the high pressure common rail tube chamber. The pressure sensor provides a rail pressure signal 109 of the high pressure fuel rail (i.e., the measured value of the fuel pressure within the high pressure common tube chamber), to the ECU 118. The ECU 118, as a core of the high pressure common rail system, is configured to provide, based on various operation condition parameters of the fuel system (for example, the rail pressure signal 109), various control signals (or drive signals) such as the drive signal 104 driving the flow metering unit (to control the extent of opening of the flowing metering unit), the drive signal 108 for driving the fuel injector electromagnetic valve 110 (to control the opening and closing of the fuel injector electromagnetic valve), etc.

Besides, in the system as shown in FIG. 1, extra fuel as pre-pressurized through the low-pump 103 will flow back to the fuel tank 101 through the one-way valve 114, and the extra fuel in the fuel injector will flow back to the fuel tank through a fuel injector low pressure circuit 112.

As can be seen from the FIG. 1 and the above depiction of the high pressure common rail system, the high pressure common rail system 100 includes a large number of components, and its operation condition is very complex. Therefore, it would be rather difficult to accurately control the rail pressure in the high pressure common rail tube chamber 117 through controlling the fuel flow metering unit.

Therefore, in order to solve this technical problem, the inventors design a technical solution for controlling a high pressure common rail system to obtain a desired rail pressure. The inventors apply the knowledge about a model of the high pressure common rail system to system control, so as to achieve an effective control that cannot be implemented in the prior art through leveraging the model knowledge about the fuel flow metering valve, the high pressure fuel pump, the high pressure common rail tube chamber, and the fuel injector. Hereinafter, detailed depiction will be made to the technical solution as provided by the present invention with reference to particular embodiments, such that those skilled in the art can easily understand and implement the present invention based on the disclosure here.

Figure 2:
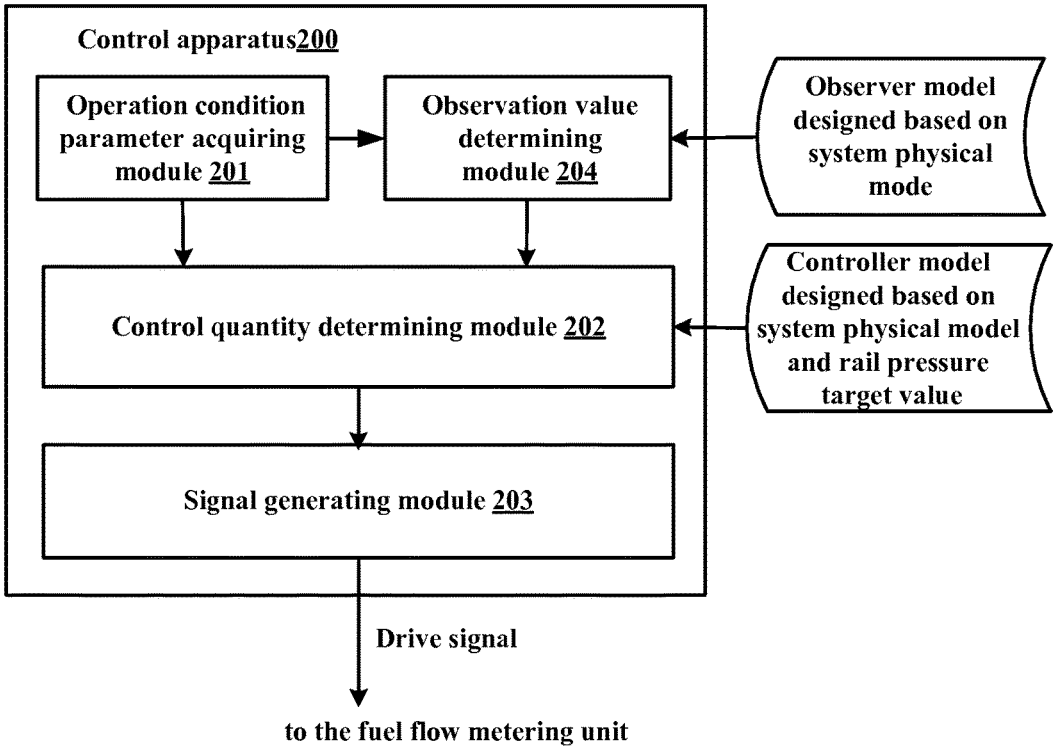
FIG. 2 schematically illustrates a block diagram of an apparatus for controlling a high pressure common rail system of a diesel engine according to an embodiment of the present invention.

First, reference will be made to FIG. 2 to depict an apparatus for controlling a high pressure common rail system of a diesel engine as provided in the present invention. FIG. 2 schematically illustrates an exemplary block diagram of an apparatus for controlling a high pressure common rail system according to an embodiment of the present invention. Those skilled in the art would appreciate that the apparatus 200 may be specifically implemented as, for example, the electric control unit 118 of FIG. 1. However, the present invention is not limited thereto, and it may also be implemented as a standalone control device.

As shown in FIG. 2, the control apparatus 200 may include an operation condition parameter acquiring module 201, a control quantity determining module 202, a signal generating module 203, and preferably it may further include an observation value determining module 204. The operation condition parameter acquiring module 201 is coupled to the control quantity determining module 202 and configured to acquire operation condition parameters associated with the high pressure common rail system, so as to provide these operation condition parameters to the control quantity determining module 202. The control quantity determining module 202 is coupled to the signal generating module and configured to determine the control quantity based on the operation condition parameters acquired from the operation condition parameter acquiring module 201, a target value of the fuel pressure within the high pressure common tube chambe(i.e., rail pressure), and a control model designed based on a physical model of the high pressure common rail system.

Hereinafter, an exemplary embodiment will be depicted with reference to examples to illustrate how to build a physical model of the high pressure common rail system. It should be noted that in the embodiments of the present invention, any appropriate manner may be used to build a physical model characterizing the high pressure common rail system, and it is not limited the exemplary embodiment shown here.

In this exemplary embodiment, the physical model of the high pressure common rail system can be characterized by the following: an expression for fuel outflow of the flow metering unit; an expression for the fuel pressure within the plunger pump chamber; an expression for the fuel outflow of the plunger pump chamber; an expression for the fuel pressure within the high pressure common rail tube chamber; and an expression for the fuel injection flow of a fuel injector. Hereinafter, these expressions will be depicted in detail. However, it should be noted that it is only for exemplary purposes, and the present invention is not limited thereto.

Physical Model of the High Pressure Common Rail

In order to consider physical relationships between major mechanical, hydraulic, and control components of the high pressure common rail fuel system while designing a model-based rail pressure control model by leveraging the given physical model, the following hypotheses are made first:

- The fuel leakage of the high pressure common rail system is ignored;
- The flow metering unit is driven by the proportional electromagnetic value;
- The impact on the fuel density from the change in both the temperature and fuel pressure is ignored;
- The fuel flow coefficient does not vary with temperature and pressure; and
- The elastic modulus of the fuel does not vary with temperature.

Given the above hypotheses, the following relationship equations may be derived.

1. Equation for Fuel Outflow of the Flow Metering Unit

For the flow metering unit, it may derive, for example, the following equation for the fuel outflow:

$$Q_u = C_u u\sqrt{\frac{2(P_u - P_p)}{\rho}} \quad \text{(Equation 1)}$$

wherein $Q_u$: the fuel flow into the plunger pump chamber (i.e., the fuel flow out of the flow metering unit);

$C_u$: the flow coefficient of the flow metering unit (constant);

u: the equivalent cross-sectional area of the flow metering valve of the flow metering unit, which is the control quantity of the system;

ρ: the fuel density (constant);

$P_u$: the fuel supply pressure of the low pressure pump (constant); and $P_p$: the fuel pressure within the plunger pump chamber.

2. Equation for Fuel Pressure within the Plunger Pump Chamber

For the high pressure pump, for example, the following equation about the fuel pressure within the plunger pump chamber may be derived:

$$\dot{P}_p = \frac{\beta_p}{V_p}(Q_u - Q_r + A_p\vartheta) \quad \text{(Equation 2)}$$

wherein, $P_p$: the fuel pressure within the plunger pump chamber;

$\beta_p$: the elastic modulus of fuel within the plunger pump chamber, $\beta_p=$ $\beta_p(P_p)$, wherein $\beta_p(P_p)$ is known as the polynomial of $P_p$, i.e., $\beta_p$ is associated with $P_p$ and is a function thereof;

$V_p$: the volume of the plunger pump chamber. $V_p=V_{max}-A_p h(\theta)$, wherein $A_p$ is the cross-sectional area of the plunger pump chamber; $h(\theta)$ is the plunger lift, and θ is the camshaft rotating angle;

$Q_u$: the fuel flow into the plunger pump chamber;

$Q_r$: the fuel flow from the plunger pump chamber into the high pressure common rail chamber;

$A_p$: as aforementioned, the cross-sectional area of the plunger pump chamber (constant); and θ: the plunger movement line speed, a function of the diesel engine rotating speed, wherein $$\vartheta = \omega_c \frac{dh(\theta)}{d\theta},$$

$\omega_c$ denotes the fuel pump camshaft rotating speed.

3. Equation for Fuel Outflow of the Plunger Pump Chamber

For the high pressure pump, for example, the following equation about the fuel outflow of the plunger pump chamber may be derived:

$$Q_r = C_r A_r\sqrt{\frac{2(P_p - P_r)}{\rho}} \quad \text{(Equation 3)}$$

wherein, $Q_r$: the fuel flow from the plunger pump chamber into the high pressure common rail tube chamber;

$C_r$: the flow coefficient of one-way valve from the plunger pump chamber to the high pressure common rail tube chamber (constant);

$A_r$: the equivalent cross-sectional area (constant) of one-way valve from the plunger pump chamber to the high pressure common rail tube chamber (constant);

$P_p$: the fuel pressure within the plunger pump chamber;

$P_r$: the fuel pressure within the high pressure common rail tube chamber; and

ρ: the fuel density (constant)

4. Equation for Fuel Pressure within the High Pressure Common Rail Tube Chamber

For the high pressure common rail tube chamber, for example, the following equation may be determined:

$$\dot{P}_r = \frac{\beta_r}{V_r}(Q_r - Q_{inj}) \quad \text{(Equation 4)}$$

wherein, $P_r$: the fuel pressure within the high pressure common rail tube chamber;

$\beta_r$: the elastic modulus of fuel within the high pressure common rail tube chamber, $\beta_r=\beta_r(P_r)$, wherein $\beta_r(P_r)$ is a polynomial of $P_r$, i.e., a function of $P_r$;

$V_r$: the volume of the high pressure common rail tube chamber (constant);

$Q_r$: the fuel flow from the plunger pump chamber into the high pressure common rail chamber; and $Q_{inj}$: the flow injected from the fuel injector to the cylinders 5. Equation for Fuel Injection Flow of a Fuel Injector For the high pressure common rail tube chamber, for example, the following equation may be determined:

$$Q_{inj} = C_{inj}A_{inj}\sqrt{\frac{2(P_r - P_{cyl})}{\rho}} \quad \text{(Equation 5)}$$

wherein, $Q_{inj}$: the flow injected from the fuel injector to the cylinders;

$C_{inj}$: the fuel injector flow coefficient (constant);

$A_{inj}$: the equivalent cross-sectional area of the fuel injector (constant);

$P_r$: the fuel pressure within the high pressure common rail tube chamber;

$P_{cyl}$: the compressed air pressure within the cylinders (constant); and

ρ: the fuel density (constant).

Based on the physical model of a high pressure common rail system as given hereinabove, a control model for the system may be designed. Hereinafter, a control model designed based on the system physical model will be depicted with reference to embodiments. However, it should be noted that these embodiments are provided only for illustration purposes, and the present invention is not limited thereto. Instead, under the teaching of the present invention, those skilled in the art may make various modifications and alternations.

Control Model Design

The control model design intends to make, under various operation conditions of an engine, the rail pressure measured value approach to the rail pressure target value by performing a closed-loop control on the fuel pressure within the high pressure fuel rail. Hereinafter, there is provided an exemplary embodiment of designing a control model based on the physical model of the high pressure common rail system.

First, $P_{r,des}$ may be used to denote the rail pressure target value of the high pressure common rail tube chamber, and $P_r$ is used to denote the actual measured value of the rail pressure. Then, the error between the actual measured value $P_r$ and the target value $P_{r,des}$ may be expressed as:

$$e = P_r - P_{r,des} \quad \text{(Equation 6)}$$

By moving the target valued $P_{r,des}$ to the side of the error e, the following equation may be derived:

$$P_r = e + P_{r,des} \quad \text{(Equation 7)}$$

By taking the time derivative of both sides of equation 7, it may derive the following equation:

$$\dot{e} = \dot{P}_r \quad \text{(Equation 8)}$$

$$\ddot{e} = \ddot{P}_r \quad \text{(Equation 9)}$$

By taking the time derivative of the left and right sides of the aforementioned equation 4, the following equation may be derived:

$$\ddot{P}_r = \frac{\dot{\beta}_r}{V_r}(Q_r - Q_{inj}) + \frac{\beta_r}{V_r}(\dot{Q}_r - \dot{Q}_{inj}) \quad \text{(Equation 10)}$$

By taking the time derivative of both sides of the aforementioned equation for the fuel outflow of the plunger pump chamber, the following may be derived:

$$\dot{Q}_r = C_rA_r\sqrt{\frac{2}{\rho}} \cdot \frac{1}{2} \cdot \frac{1}{\sqrt{(P_p - P_r)}}(\dot{P}_p - \dot{P}_r) = \quad \text{(Equation 11)}$$

-continued $$C_rA_r\sqrt{\frac{1}{2\rho(P_p - P_r)}} \cdot (\dot{P}_p - \dot{P}_r)$$

Likewise, by taking the time derivative of both sides of the aforementioned equation for the fuel injection flow of the fuel injector, the following may be derived:

$$\dot{Q}_{inj} = C_{inj}A_{inj}\frac{1}{\sqrt{2\rho(P_r - P_{cyl})}}\dot{P}_r \quad \text{(Equation 12)}$$

By substituting the above derived equations 11 and 12 into the equation 10, then equation 10 may be further simplified as:

$$\ddot{P}_r = \frac{\dot{\beta}_r}{V_r}(Q_r - Q_{inj}) + \frac{\beta_r}{V_r}C_rA_r \cdot \frac{1}{\sqrt{2\rho(P_p - P_r)}}\dot{P}_p - \frac{\beta_r}{V_r}\left(C_rA_r\sqrt{\frac{1}{2\rho(P_p - P_r)}} + C_{inj}A_{inj}\frac{1}{\sqrt{2\rho(P_r - P_{cyl})}}\right)\dot{P}_r \quad \text{(Equation 13)}$$

By substituting the aforementioned equation for fuel outflow of the flow metering unit (i.e., equation 1); the equation for the fuel pressure within the plunger pump chamber (i.e., equation 2); and the equation for fuel pressure within the high pressure common rail tube chamber (equation 4) into the right end of the equation 13, and considering $$\dot{\beta}_r = \frac{d\beta}{dP_r}\dot{P}_r,$$

the following equation may be derived:

$$\ddot{P}_r = \frac{d\beta}{dP_r}\frac{\beta_r}{V_r^2}(Q_r - Q_{inj})^2 + \frac{\beta_r\beta_p}{V_rV_p}C_rA_r \cdot \frac{1}{\sqrt{2\rho(P_p - P_r)}}(Q_u - Q_r + A_p\vartheta) - \frac{\beta_r^2}{V_r^2}\left(C_rA_r\sqrt{\frac{1}{2\rho(P_p - P_r)}} + C_{inj}A_{inj}\frac{1}{\sqrt{2\rho(P_r - P_{cyl})}}\right)(Q_r - Q_{inj}) = \left[\frac{d\beta}{dP_r}\frac{\beta_r}{V_r^2}(Q_r - Q_{inj}) - \frac{\beta_r^2}{V_r^2}\left(C_rA_r\sqrt{\frac{1}{2\rho(P_p - P_r)}} + C_{inj}A_{inj}\frac{1}{\sqrt{2\rho(P_r - P_{cyl})}}\right)\right] \cdot (Q_r - Q_{inj}) - \frac{\beta_r\beta_pC_rA_r}{V_rV_p\sqrt{2\rho(P_p - P_r)}} \cdot Q_r + \frac{\beta_r\beta_p}{V_rV_p}C_rA_r \cdot \frac{A_p}{\sqrt{2\rho(P_p - P_r)}}\vartheta + \frac{\beta_r\beta_pC_rA_rC_u}{V_rV_p\sqrt{2\rho(P_p - P_r)}}\sqrt{\frac{2P_u}{\rho}} \cdot u \quad \text{(Equation 14)}$$

Through further arrangement, the equation 14 may be expressed as:

$$\ddot{P}_r = b_1 + b_2\vartheta + b_3 u \quad \text{(Equation 15)}$$

wherein $$b_1 = b_1(P_p, P_r) = \left[\frac{d\beta}{dP_r}\frac{\beta_r}{V_r^2}(Q_r - Q_{inj}) - \frac{\beta_r^2}{V_r^2}\left(\frac{C_r A_r}{\sqrt{2\rho(P_p - P_r)}} + \frac{C_{inj}A_{inj}}{\sqrt{2\rho(P_r - P_{cyl})}}\right)\right] \cdot (Q_r - Q_{inj}) - \frac{\beta_r\beta_p C_r A_r}{V_r V_p\sqrt{2\rho(P_p - P_r)}} \cdot Q_r$$

$$b_2 = b_2(P_p, P_r) = \frac{\beta_r\beta_p C_r A_r A_p}{V_r V_p\sqrt{2\rho(P_p - P_r)}}$$

$$b_3 = b_3(P_p, P_r) = \frac{\beta_r\beta_p C_r A_r C_u\sqrt{P_u}}{V_r V_p\rho\sqrt{2(P_p - P_r)}}$$

As depicted in the aforementioned equations 1 to 5, $\beta_p$ is the polynomial of $P_p$, $\beta_r$ is the polynomial of $P_r$, $V_p$ is the function of h(θ), and $Q_r$ and $Q_{inj}$ are functions of $P_p$ and $P_r$. Therefore, coefficients $b_1$, $b_2$, and $b_3$ are polynomials of $P_p$ and $P_r$, and they may be determined based on operation condition parameters and constant parameters associated with the physical model. Specifically, $b_1$ may be determined based on the fuel pressure value $P_P$ within the plunger pump chamber, fuel pressure value $P_r$ within the high pressure common rail chamber, pump plunger stroke h(θ)(for determining Vp), and constant parameters associated with the physical model, wherein these constants include the compressed air pressure $P_{cyl}$ within the cylinder, fuel injector flow coefficient $C_{inj}$, fuel injector equivalent cross-sectional area $A_{inj}$ fuel density ρ, flow coefficient Cr of one-way valve from the plunger pump chamber to the high pressure common rail tube chamber, equivalent cross-section area $A_r$ of the one-way valve from the plunger pump chamber to the high pressure common rail tube chamber, and high pressure common rail tube chamber volume Vr, and etc. Likewise, $b_2$ may be determined based on the fuel pressure value $P_p$ within the plunger pump chamber, fuel pressure value Pr within the high pressure common rail chamber, pump plunger stroke h(θ) (for determining Vp) and constants associated with the physical model, wherein these constants include high pressure common rail tube chamber volume $V_r$, the plunger pump chamber cross-sectional area $A_p$, the flow coefficient Cr the of the one-way valve from the plunger pump chamber to the high pressure common rail tube chamber, the equivalent cross-sectional area $A_r$ of the one-way valve from the plunger pump chamber to the high-pressure tube chamber, high-pressure common rail tube chamber volume Vr and fuel density ρ. Similarly, $b_3$ may be determined based on the fuel pressure value $P_P$ within the plunger pump chamber, fuel pressure value Pr within the high pressure common rail chamber, the pump plunger stroke h(θ)(for determining Vp) and constant parameters of the physical model, wherein these constant parameters include the low-pressure end fuel supply pressure $P_u$, fuel density ρ, the flow coefficient Cu of the flow metering unit, the flow coefficient Cr of the one-way valve from the plunger pump chamber to the high pressure common rail tube chamber, the equivalent cross-sectional area $A_r$ of the one-way valve from the plunger pump chamber to the high-pressure tube chamber, and the high pressure common rail tube chamber volume Vr.

(1) Based on the above equations 9 and 15, and let $\ddot{\theta}+k_d\dot{\theta}+k_p\theta+k_i\int\theta=0$, the control model may be designed as follows:

$$u = -\frac{1}{b_3}\left(b_1 + b_2\vartheta + k_p e + k_I\int e + k_d\dot{e}\right) \quad \text{(Equation 15)}$$

Actually, the control model includes two parts. One part thereof includes a feedforward control term:

$$u_{FF} = -\frac{1}{b_3}(b_1 + b_2\vartheta) \quad \text{(Equation 16)}$$

wherein $b_1$, $b_2$ and $b_3$ denote control coefficients, and as aforementioned, they may be determined based on the acquired operation condition parameters and constant parameters associated with the physical model; θ denotes a high pressure fuel pump plunger movement line speed.

The other part includes a PID feedback control term:

$$u_{FB} = -\frac{1}{b_3}\left(k_p e + k_I\int e + k_d\dot{e}\right) \quad \text{(Equation 17)}$$

wherein $b_3$ denotes a control coefficient, similarly as aforementioned, which may be determined based on the acquired operation condition parameters and constant parameters associated with the physical model; $k_p$, $k_I$ and $k_d$ denote control coefficients for proportional control, integral control, and differential control, respectively. For the feedback control term, appropriate $k_p$, $k_I$ and $k_d$ gain values may be selected to ensure stability of the high pressure common rail system. In other words, it should guarantee that the eigen root of the following equation is located at the left half plane of the plane:

$$\ddot{\theta}+k_d\dot{\theta}+k_p\theta+k_i\int\theta=0 \quad \text{(Equation 18)}$$

Namely, it guarantees e→0 when t→0. In this way, $k_p$, $k_I$ and $k_d$ gain values may be derived.

However, as known to those skilled in the art, the control model may include a feedforward control term, a feedback control term, or a combination of both. Moreover, the feedback control is not limited to PID control, and PI control is also feasible in practical application. Therefore, the present invention is not limited to the exemplary embodiments provided herein.

Therefore, in one preferred embodiment of the present invention, the operation condition parameters that need to be measured may include: the high pressure pump plunger stroke h, the high pressure fuel pump plunger movement line speed θ, the fuel pressure PP within the plunger pump chamber and the fuel pressure $P_r$ within the high voltage common rail tube chamber.

These parameters are those required for determining the control quantity based on the control model. However, the present invention is not limited thereto. More parameters or other alternative parameters may also be measured, so as to calculate or determine these operation condition parameters from these parameters. For example, for a high pressure pump plunger stroke, which is the function of the camshaft rotating angle; thus, the camshaft rotating angle may be obtained, and the high pressure pump plunger stroke may be computed based on the physical relationship between the camshaft rotating angle and the high pressure pump plunger stroke.

It should be noted that the above provided control model is only an exemplary embodiment. Various variations for the control model are possible. For example, in some operation conditions, one or more parameters or aspects in the above equations may not be considered in the physical model, and/or new parameters or aspects about the engine high pressure fuel system may be added into the physical model. Actually, based on the above inspiration and teaching given in the present invention, those skilled in the art may design and implement any appropriate control model according to specific needs and conditions.

Besides, the control model is preferably pre-determined based on the physical model; in this way, during the running period of the engine, the value of the control quantity may be determined directly based on various operation condition parameters and the system target value. In this way, the system response speed may be accelerated and the control efficiency may be improved.

In the aforementioned operation condition parameters, some parameters may be directly measured through measurement devices such as a sensor, for example, fuel pressure Pr within the high pressure common rail tube chamber. Besides, some operation condition parameters, such as high pressure pump plunger stroke h(θ), high pressure fuel pump plunger movement line speed θ, may be derived by calculation based on other measured parameters (for example, camshaft rotating angle, pump camshaft rotating speed) and the physical relationships therebetween. In addition, there are some parameters that cannot or can hardly be obtained through measurement based on the prior art, or the costs for their implementation are high. For such parameters, they may be estimated through the states of other relevant parameters or through empirical manners. One example of such parameters is the fuel pressure $P_P$ within the plunger pump chamber of a high pressure pump.

According to one preferred embodiment of the present invention, there is further included an observation value determining module 204 configured to determine an observation value of a parameter such as the fuel pressure within the plunger pump chamber. As shown in FIG. 2, the observation value determining module 204 is coupled to the operation condition parameter acquiring module 201 and the control quantity determining module 202 and configured to determine an observation value of the fuel pressure $P_P$ within the high pressure pump plunger chamber based on the operation condition parameters and an observer model designed based on the physical model, so as to be used by the control quantity determining module to determine the control quantity. Hereinafter, for a purpose of illustration, an instance of designing a state observer model will be provided. However, it should be noted that, as known to those skilled in the art, various means may be adopted to design the observer.

Fuel Pressure State Observer Model

In order to determine an observe value of the fuel pressure $P_P$ within a plunger pump chamber, the observer will be designed by means of the aforementioned the equation 2 for the fuel pressure within the plunger pump chamber and the equation 4 for the fuel pressure within the high pressure common rail tube chamber.

First, suppose the state observation value of the fuel pressure $P_P$ within the plunger pump chamber is $\hat{P}_p$, the measured value of the fuel pressure within the high pressure common rail tube chamber is $P_r$, and the state observation value of the fuel pressure within the high pressure common rail tube chamber is $\hat{P}_r$.

Based on the equations 2 and 4, through designing an observer by adding adjustment terms to the fuel pressure equation within the plunger pump chamber and the fuel pressure equation within the high pressure common rail tube chamber and substituting the equation 3 and equation 5 into equations 2 and 4, the following two equations may be derived:

$$\dot{\hat{P}}_p = \frac{\beta_p}{V_p}\left(Q_u - C_r A_r\sqrt{\frac{2(\hat{P}_p - \hat{P}_r)}{\rho}} + A_p\vartheta\right) + L_p(\hat{P}_r - P_r) \quad \text{(Equation 19)}$$

$$\dot{\hat{P}}_r = \frac{\beta_r}{V_r}\left(C_r A_r\sqrt{\frac{2(\hat{P}_p - \hat{P}_r)}{\rho}} - C_{inj}A_{inj}\sqrt{\frac{2(\hat{P}_r - P_{cyl})}{\rho}}\right) + L_r(\hat{P}_r - P_r) \quad \text{(Equation 20)}$$

Wherein the adjustment factors Lp and Lr related to the adjustment items in expressions 19 and 20 may be selected as appropriate values that stabilize and converge both of the above two expressions 19 and 20. It may be determined based on the requirements of actual application.

Therefore, there is a solution to the equation simultaneously formed by the equations 19 and 20. Thus, it means the value of $\hat{P}_p$ or preferably both values of $\hat{P}_p$ and $\hat{P}_r$, may be derived based on the operation condition parameters (including, for example, the plunger pump volume Vp (or the plunger pump stroke h), fuel flow $Q_u$ of the plunger pump chamber (or the metering unit equivalent cross-sectional area u of the flow metering unit electromagnetic value), plunger movement line speed θ) and the rail pressure $P_r$ of the high pressure common rail.

Thus, in the preferred embodiment, the observation value determining module 204 may determine the observation value $\hat{P}_p$ of the fuel pressure within the high pressure pump plunger chamber based on the physical model and the operation condition parameters, so as to be used in determining the control quantity as depicted infra. Preferably, the observation value $\hat{P}_r$ of the fuel pressure within the high pressure common rail tube chamber may be further determined, so as to be used for determining the control quantity as depicted infra.

Actually, the control quantity may also be determined using the measured value of the fuel pressure within the high pressure common rail tube chamber. However, it is preferable to use the observation value $\hat{P}_r$ of the fuel pressure within the high pressure common rail tube chamber, because the observation value $\hat{P}_r$ actually corresponds to a filtered value of the measured value $P_r$, such that use of the observation value may enhance the accuracy of the control model.

Figure 3:
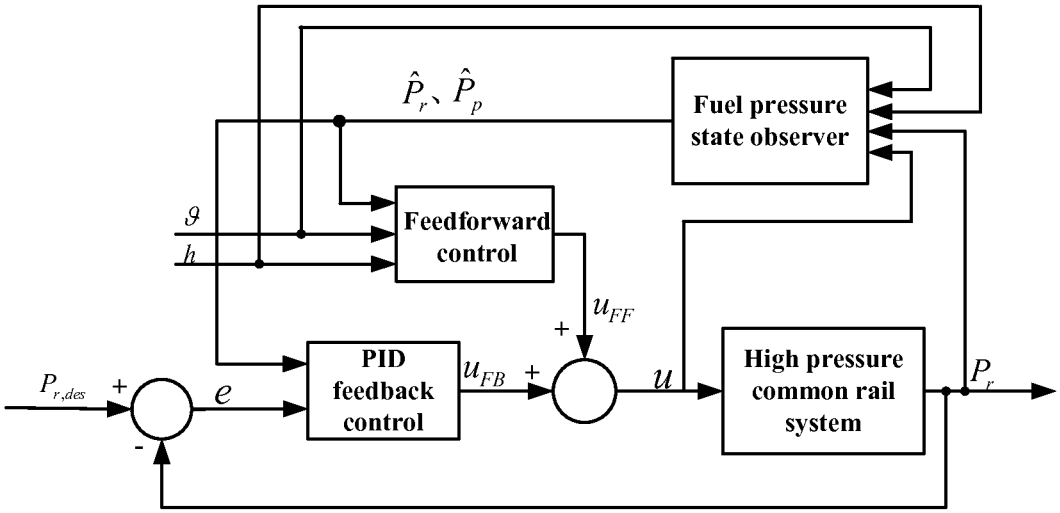
FIG. 3 schematically illustrates a schematic block diagram of closed-loop feedback control of a high pressure common rail system of the diesel engine according to the present invention.

For the sake of clarity, FIG. 3 shows a schematic block diagram of a closed-loop feedback control model of a high pressure common rail system of a diesel engine according to a preferred embodiment of the present invention. As shown in FIG. 3, the high pressure common rail system includes an observer and a controller that includes a feedforward control section and a PID feedback control section. The error between the actual measurement rail pressure value and the target rail pressure value is provided to the aforementioned PID feedback control section, and provides a feedback control component $u_{FB}$ through the PID feedback control section based on the acquired operation condition parameters. On the other hand, the fuel pressure state observer observes the observation values $\hat{P}_p$ and $\hat{P}_r$ of the fuel pressures within the plunger pump chamber and the high pressure common rail tube chamber based on the control quantity u, the rail pressure actual observation value Pr, and the acquired operation condition parameter pump plunger stroke h and the plunger movement line speed θ, respectively. The feedforward control section provides the feedforward control component $u_{FF}$ based on the two observation values and the measured operation condition parameters (i.e., the pump plunger stroke h and the plunger movement line speed θ). The two components $u_{FB}$ and $u_{FF}$ jointly form the control quantity u, i.e., the equivalent cross-sectional area of the electromagnetic valve of the flow metering unit.

Accordingly, operation condition parameters that may meet the control requirements include: high pressure pump plunger stroke h, high pressure fuel pump plunger movement line speed θ, fuel pressure $P_r$ within the plunger pump chamber, and fuel pressure $P_p$ within the high pressure common rail tube chamber Pp. The value of the equivalent cross-section area u of the flow metering unit electromagnetic valve as used in observing $P_r$ and $P_p$ may be the control quantity u derived from the previous computation.

Therefore, as above mentioned, the observation value determining module 204 may determine the observation values of the fuel pressure within the plunger pump chamber and the fuel pressure within the high pressure common tail tube chamber, based on the operation condition parameters measured or computed by the operation condition acquiring module 201 and based on for example the observer model as previously designed. Then, the control quantity determining module 202 may use these operation condition parameters (including the fuel pressure value observed through the observer), the control model determined based on the physical model and the rail pressure target value to determine the control quantity, i.e., the equivalent cross-section area of the flow metering unit. Further, the drive signal generating module 203 may generate a drive signal for driving the fuel level metering unit based on the magnitude of the control quantity.

According to embodiments of the present invention, particularly the preferred embodiments, the proposed control apparatus performs control based on the physical model of the high pressure common rail fuel injection system of a diesel engine. Because the physical model of the high pressure common rail fuel injection system of the diesel engine is applicable to a working process of the system in any operation condition, the physical model-based technical solution of the present invention may achieve an accurate injection pressure and a fast system response, which in turn may reduce the offset between the actual pressure of the rail pressure and its target value and minimize it in preferred embodiments. In addition, a control model designed based on the physical model of the high-pressure common rail fuel system can be quantized, which thus greatly reduces the calibration workload for the control model, and improves the efficiency and functionality of the high pressure common rail fuel injection system of the engine.

Besides, the present invention further provides a method for controlling a high pressure common rail system of a diesel engine. Next, detailed depiction will be made with reference to FIG. 4, which schematically illustrates a flowchart of a method for controlling a high pressure common rail system of a diesel engine according to an embodiment of the present invention.

Figure 4:
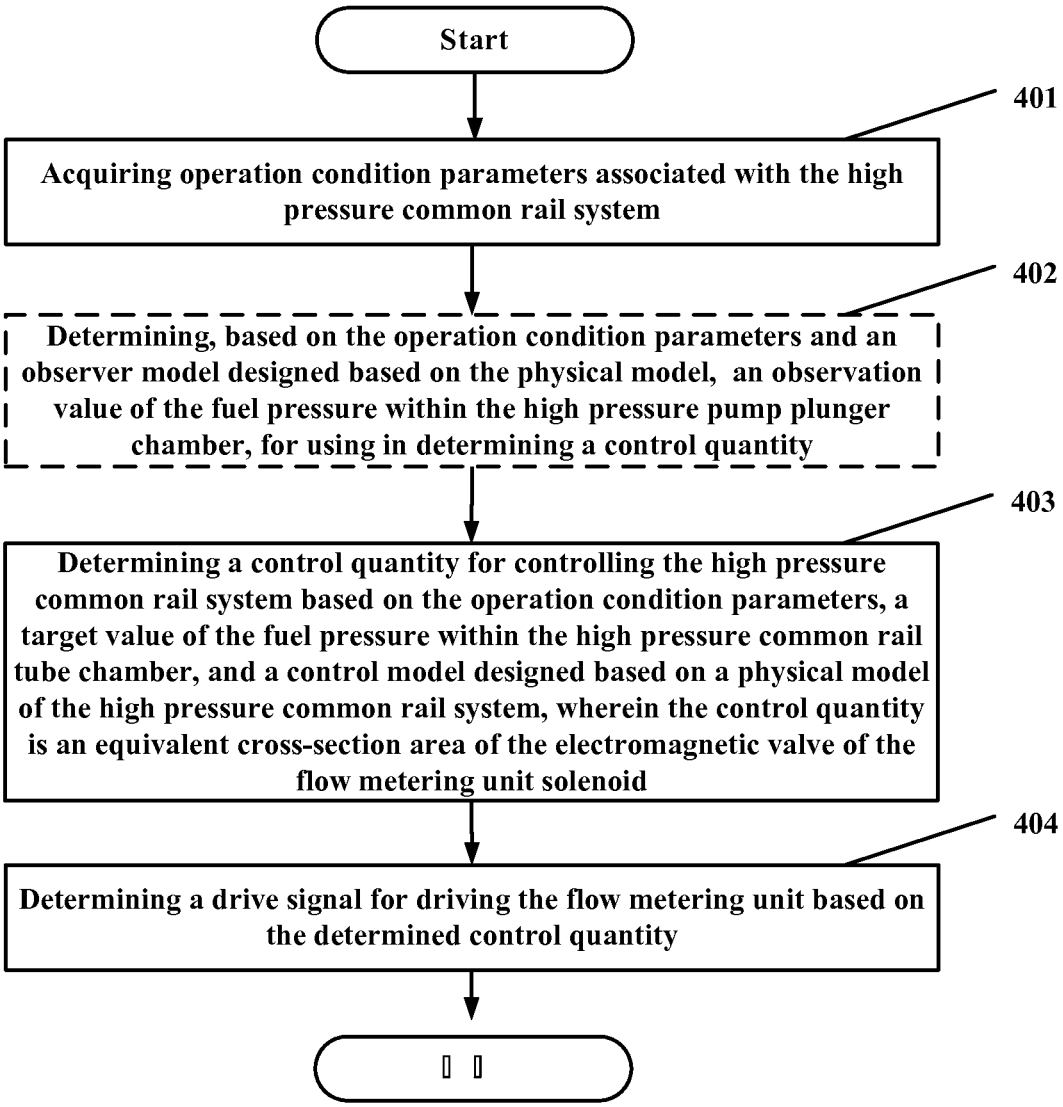
FIG. 4 schematically illustrates a flowchart of a method for controlling a high pressure common rail system of a diesel engine according to an embodiment of the present invention.

As shown in FIG. 4, first at step 401, operation condition parameters associated with the high pressure common rail system are obtained. As previously mentioned, the operation condition parameters may include: high pressure fuel pump plunger stroke, high pressure fuel pump plunger movement line speed, fuel pressure within the plunger pump chamber, and fuel pressure within the high pressure common rail tube chamber.

In preferred embodiments, as above mentioned, an observation value of fuel pressure within the high pressure pump plunger chamber may be determined at step 402 based on the operation condition parameters and an observer model designed based on the physical model, so as to be used in determining the control quantity as depicted infra. According to an embodiment of the present invention, the observer model may be designed by adding an adjustment term to an expression for the fuel pressure within the plunger pump chamber and to expression for the fuel pressure within the high pressure common rail tube cavity in the physical model, respectively, and by selecting an adjustment factor to make both adjusted expressions stable and converged. More preferably, an observation value of fuel pressure within the high pressure common rail tube chamber may be determined based on the operation condition parameters and the observer model, so as to be used for determining the control quantity.

Next, at step 403, a control quantity for controlling the high pressure common rail system may be determined based on the operation condition parameters, the target value of the fuel pressure within the high pressure common rail tube chamber, and a control model designed based on the physical model of the high pressure common rail system, wherein the control quantity is an equivalent cross-section area of the flow metering unit electromagnetic valve.

In an embodiment of the present disclosure, the physical model of the high pressure common rail system can be characterized by: an expression for the fuel outflow of the flow metering unit; an expression for the fuel pressure within the plunger pump chamber; an expression for fuel outflow of the plunger pump chamber; an expression for the fuel pressure within the high pressure common rail tube chamber; and an expression for the fuel injection of a fuel injector.

Besides, the control model designed based on the physical model may include a feedforward controller, and the control quantity includes a feedforward control component. In an embodiment of the present invention, the feedforward control component $u_{FF}$ may be expressed as:

$$u_{FF} = -\frac{1}{b_3}(b_1 + b_2\vartheta)$$

wherein $b_1$, $b_2$ and $b_3$ are control coefficients, and as aforementioned, they may be determined based on the acquired operation condition parameters and constant parameters associated with the physical model; θ denotes a high pressure fuel pump plunger movement line speed Additionally or alternatively, the control model may include a feedback controller, for example, a PID feedback control term, and the control quantity includes a feedback control component. In an embodiment of the present invention, the feedback control component $u_{FB}$ may be expressed as:

$$u_{FB} = -\frac{1}{b_3}\left(k_p e + k_1 \int e + k_d \dot{e}\right)$$

wherein e denotes an error between the fuel pressure within the high pressure common rail tube cavity and its target value; $b_3$ is a control coefficient, which may be determined based on the acquired operation condition parameters and constant parameters associated with the physical model; $k_p$, $k_l$ and $k_d$ are control coefficients respectively for proportional control, integral control, and differential control, and the $k_p$, $k_l$ and $k_d$ gain values may be selected to stabilize the high pressure common rail system.

Afterwards, at step 404, a drive signal for driving the flow metering unit may be determined based on the determined control quantity.

Operations of various steps in this method substantially correspond to the operations of various components of the control device as depicted above. Therefore, for specific operations of respective steps in the method or details of relevant contents therein, they may refer to the above depiction on the control apparatus with reference to FIGS. 2 and 3.

Besides, it should be noted that the embodiments of the present invention can be implemented in hardware, software or the combination thereof. The hardware part can be implemented by a special logic; the software part can be stored in a memory and executed by a proper instruction execution system such as a microprocessor or a design-specific hardware. The normally skilled in the art may understand that the above method and system may be implemented with a computer-executable instruction and/or in a processor controlled code, for example, such code is provided on a bearer medium such as a magnetic disk, CD, or DVD-ROM, or a programmable memory such as a read-only memory (firmware) or a data bearer such as an optical or electronic signal bearer. The apparatuses and their components in the present invention may be implemented by hardware circuitry of a programmable hardware device such as a very large scale integrated circuit or gate array, a semiconductor such as logical chip or transistor, or a field-programmable gate array, or a programmable logical device, or implemented by software executed by various kinds of processors, or implemented by combination of the above hardware circuitry and software.

It should be noted that although a plurality of devices or sub-device of the control apparatus have been mentioned in the above detailed depiction, such partitioning is merely non-compulsory. In actuality, according to the embodiments of the present invention, the features and functions of the above described two or more means may be embodied in one means. In turn, the features and functions of the above described one means may be further embodied in more modules.

Besides, although operations of the present methods are described in a particular order in the drawings, it does not require or imply that these operations must be performed according to this particular sequence, or a desired outcome can only be achieved by performing all shown operations. Instead, the execution order for the steps as depicted in the flowcharts may be varied. Additionally or alternatively, some steps may be omitted, a plurality of steps may be merged into one step, or a step may be divided into a plurality of steps for execution.

Although the present invention has been depicted with reference to the currently considered embodiments, it should be understood that the present invention is not limited the disclosed embodiments. On the contrary, the present invention intends to cover various modifications and equivalent arrangements included in the spirit and scope of the appended claims. The scope of the appended claims accords with the broadest explanations and covers all such modifications and equivalent structures and functions.

What is claimed is:

1. An apparatus for controlling a high pressure common rail system of a diesel engine, comprising:

a memory storing computer executable components; and a processor configured to execute the following computer executable components in the stored memory:

an operation condition parameter acquiring module, configured to acquire operation condition parameters associated with the high pressure common rail system;

a control quantity determining module, coupled to the operation condition parameter acquiring module and configured to determine a control quantity for controlling the high-pressure common rail system based on the operation condition parameters, a target value of fuel pressure within a high pressure common rail tube chamber and a control model designed based on a physical model characterizing the high pressure common rail system, wherein the control quantity is an equivalent cross-section area of a flow metering unit electromagnetic valve;

a drive signal determining module coupled to the control quantity determining module and configured to determine a drive signal for driving the flow metering unit based on the determined control quantity; and an observation value determining module, coupled to the operation condition parameter acquiring module and the control quantity determining module and configured to determine, based on the operation condition parameters and an observer model designed based on the physical model, an observation value of fuel pressure within a high pressure fuel pump plunger chamber, for using by the control quantity determining module in determining the control quantity, wherein the control model comprises a feedforward controller and the control quantity comprises a feedforward control component, wherein the feedforward control component $u_{FF}$ is expressed as:

$$u_{FF} = -\frac{1}{b_3}(b_1 + b_2\vartheta),$$

and wherein $b_1$ $b_2$ and $b_3$ denote control coefficients determined based on the acquired operation condition parameters and constant parameters associated with the physical model; and θ denotes high pressure fuel pump plunger movement line speed.

2. The apparatus of claim 1, wherein the observer model is designed by adding an adjustment term to an expression for fuel pressure within a plunger pump chamber and to an expression for the fuel pressure within the high pressure common rail tube cavity in the physical model, respectively, and by selecting an adjustment factor to make adjusted expressions stable and converged.

3. The apparatus of claim 1, wherein the observation value determining module is further configured to:

determine an observation value of the fuel pressure within the high pressure common rail tube chamber based on the operation condition parameters and the observer model, for using by the control quantity determining module in determining the control quantity.

4. The apparatus of claim 1, wherein the operation condition parameters include: high pressure fuel pump plunger stroke, high pressure fuel pump plunger movement line speed, fuel pressure within the plunger pump chamber, and fuel pressure within the high pressure common rail tube chamber.

5. The apparatus of claim 1, wherein the physical model may be characterized by:

an expression for fuel outflow of the flow metering unit;

an expression for fuel pressure within the plunger pump chamber;

an expression for fuel outflow of the plunger pump chamber;

an expression for the fuel pressure within the high pressure common rail tube chamber; and an expression for fuel injection flow of a fuel injector.

6. The apparatus of claim 1, wherein the control model further comprises a feedback controller, and wherein the control quantity further comprises a feedback control component.

7. The apparatus of claim 6, wherein the feedback control component $u_{FB}$ is expressed as:

$$u_{FB} = -\frac{1}{b_3}\left(k_p e + k_1 \int e + k_d \dot{e}\right)$$

wherein e denotes an error between the fuel pressure within the high pressure common rail tube chamber and its target value; and $k_P$, $k_i$ and $k_d$ denote control coefficient respectively for proportional control, integral control and differential control, and $k_P$, $k_i$ , and $k_d$ are selected to stabilize the high pressure common rail system.

8. A method for controlling a high pressure common rail system of a diesel engine, comprising:

acquiring operation condition parameters associated with the high pressure common rail system;

determining a control quantity for controlling the high-pressure common rail system based on the operation condition parameters, a target value of fuel pressure within a high pressure common rail tube chamber and a control model designed based on a physical model characterizing the high pressure common rail system, wherein the control quantity is an equivalent cross-section area of a flow metering unit electromagnetic valve;

determining a drive signal for driving the flow metering unit based on the determined control quantity; and determining, based on the operation condition parameters and an observer model designed based on the physical model, an observation value of fuel pressure within a high pressure fuel pump plunger chamber, for using by the control quantity determining module in determining the control quantity, wherein the control model comprises a feedforward controller and the control quantity comprises a feedforward control component, wherein the feedforward control component $u_{FF}$ is expressed as:

$$u_{FF} = -\frac{1}{b_3}(b_1 + b_2\vartheta),$$

and wherein $b_1$, $b_2$ and $b_3$ denote control coefficients determined based on the acquired operation condition parameters and constant parameters associated with the physical model; and θ denotes high pressure fuel pump plunger movement line speed.

9. The method of claim 8, wherein the observer model is designed by adding an adjustment term to an expression for fuel pressure within the plunger pump chamber and to an expression for the fuel pressure within the high pressure common rail tube cavity in the physical model, respectively, and by selecting an adjustment factor to make both adjusted expressions stable and converged.

10. The method of claim 8, further comprising:

determining an observation value of the fuel pressure within the high pressure common rail tube chamber based on the operation condition parameters and the observer model, for using in determining the control quantity.

11. The method of claim 8, wherein the operation condition parameters include: high pressure fuel pump plunger stroke, high pressure fuel pump plunger movement line speed, fuel pressure within the plunger pump chamber, and fuel pressure within the high pressure common rail tube chamber.

12. The method of claim 8, wherein the physical model may be characterized by:

an expression for fuel outflow of the flow metering unit;

an expression for fuel pressure within the plunger pump chamber;

an expression for fuel outflow of the plunger pump chamber;

an expression for fuel pressure within the high pressure common rail tube chamber; and an expression for fuel injection flow of a fuel injector.

13. The method of claim 8, wherein the control model further comprises a feedback controller, and wherein the control quantity further comprises a feedback control component.

14. The method of claim 13, wherein the feedback control component $u_{FB}$ is expressed as:

$$u_{FB} = -\frac{1}{b_3}\left(k_p e + k_1 \int e + k_d \dot{e}\right),$$

wherein e denotes an error between the fuel pressure within the high pressure common rail tube chamber and its target value; and $k_P$, $k_i$, and $k_d$ denote control coefficients respectively for proportional control, integral control and differential control, and $k_P$, $k_i$, and $k_d$ are selected to stabilize the high pressure common rail system.

* * * * *